US005253553A

United States Patent [19]

Mothershead

[11] Patent Number: 5,253,553

[45] Date of Patent: Oct. 19, 1993

[54] APPARATUS AND METHOD FOR REMOVING A STOPPER FROM A BOTTLE

[76] Inventor: Michael Mothershead, 1733 Avon Way, Forest Grove, Oreg. 97116

[21] Appl. No.: 855,833

[22] Filed: Mar. 23, 1992

[51] Int. Cl.[5] ..... B67B 7/10

[52] U.S. Cl. ..... 81/3.48

[58] Field of Search ..... 81/3.07, 3.4, 3.48; 30/324, 325, 345; D8/18, 33, 40, 42

[56] References Cited

U.S. PATENT DOCUMENTS

| | | | |
|---|---|---|---|
| 72,247 | 12/1867 | Waterman . | |
| 120,830 | 11/1871 | Simpers . | |
| 199,760 | 1/1878 | Tyrer . | |
| 889,474 | 6/1908 | Medley . | |
| 983,778 | 2/1911 | Sersen . | |
| 2,634,497 | 4/1953 | Waldesbuehl | 30/324 |
| 2,895,357 | 7/1959 | Perez | 81/3.07 |
| 2,939,216 | 6/1960 | Armstrong | 30/324 |
| 3,967,512 | 7/1976 | Soldano | 81/3.07 |
| 4,679,467 | 7/1987 | Delnero | 81/3.07 |
| 4,969,268 | 11/1990 | Kelly, III | 30/324 |

FOREIGN PATENT DOCUMENTS

| | | | |
|---|---|---|---|
| 0943781 | 3/1974 | Canada | 30/324 |

OTHER PUBLICATIONS

Dixon, Stop Motion, *Willamette Week*, vol. 19, No. 14, Jan. 28, 1993, p. 24.

*Primary Examiner*—Roscoe V. Parker

*Attorney, Agent, or Firm*—Dellett and Walters

[57] ABSTRACT

A stopper remover comprises a relatively thin elongate member, having greater length than width, with a flared portion at an end thereof. In performing the method according to the invention, a stopper is removed from a bottle by curling the elongate member around the longitudinal axis thereof, inserting the flared end a sufficient distance into the neck of the bottle to capture the stopper in the flared portion, and extracting the remover from the bottle thereby removing the stopper. The remover is also advantageously employed in simply bringing the stopper back up into the neck of the bottle, enabling ultimate extraction of the stopper by conventional means.

18 Claims, 2 Drawing Sheets

APPARATUS AND METHOD FOR REMOVING A STOPPER FROM A BOTTLE

BACKGROUND OF THE INVENTION

This invention relates to an apparatus and method for removing a stopper from a bottle and more particularly to an apparatus and method for removing broken corks from wine bottles.

It is frequently the case that a stopper, particularly a cork stopper, becomes broken during the process of removing it from a bottle. Once the cork has been broken off, it can be difficult to remove the remainder of the stopper from the bottle and removal attempts often result in the lower part of the cork being forced into the bottle. In other situations, the cork may remain whole, but may be forced into the bottle interior and be left floating. Once inside the bottle, the cork is resistant to attempts to retrieve it.

While a floating cork is simply a nuisance in many situations, if a cork is broken or forced into the bottle interior during removal from a relatively expensive bottle of wine, it is unlikely that a restaurant will be able to sell the wine profitably since such wines are typically sold or served by the bottle.

SUMMARY OF THE INVENTION

In accordance with the preferred embodiment of the invention, a cork remover is constructed from a sheet of mylar of substantially greater length than width. The proximal end of the remover is adapted for grasping by the user, while the distal end is flared for capturing the cork. In use, the remover is curled about its longitudinal axis, and the flared distal end is inserted within the bottle. Once within the bottle, the remover is lowered to the level of the cork and moved to position the cork within the curled flared portion for engaging the cork. Cork extraction is then accomplished by pulling the remover out of the bottle, whereupon the cork is also withdrawn.

It is accordingly an object of the present invention to provide an improved cork remover for extracting broken corks from bottles.

It is another object of the present invention to provide an improved method of repositioning a cork within the neck of a bottle after the cork has fallen into the bottle interior.

It is still another object of the present invention to provide an improved apparatus for retrieving a stopper that has been forced into the interior of a bottle.

It is a related object of the present invention to provide and improved method and apparatus for removing a cork from a bottle without the need for a corkscrew.

The subject matter of the present invention is particularly pointed out and distinctly claimed in the concluding portion of this specification. However, both the organization and method of operation, together with further advantages and objects thereof, may best be understood by reference to the following description taken in connection with accompanying drawings wherein like reference characters refer to like elements.

DETAILED DESCRIPTION

Figures 1, 2, 3, 4, 5:
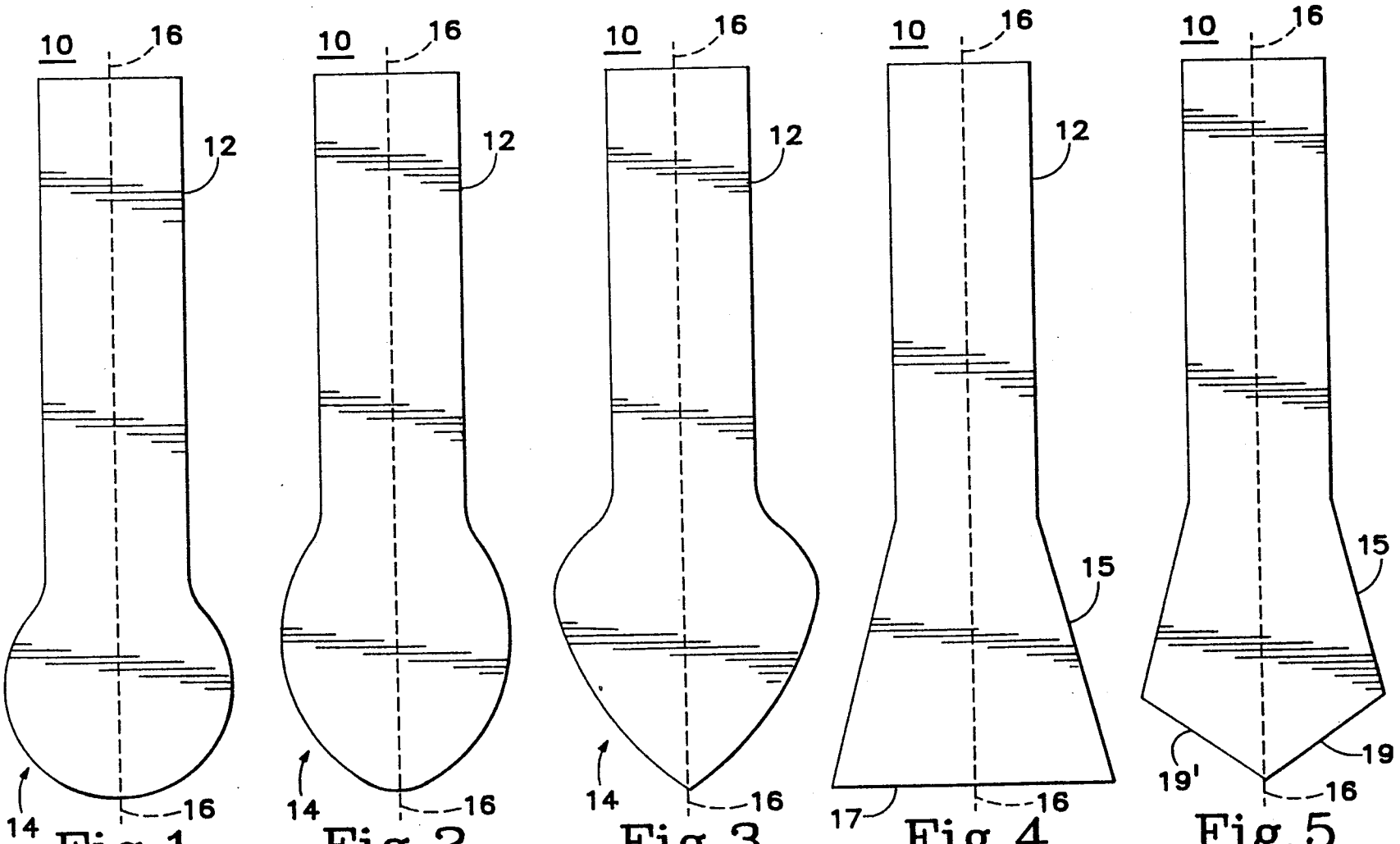
FIG. 1 is a view of a first embodiment of the stopper remover according to the present invention.
FIG. 2 is a view of a second embodiment of the present invention.
FIG. 3 is a view of a third embodiment of the stopper remover in accordance with the present invention.
FIG. 4 is a view of a fourth embodiment of the present invention.
FIG. 5 is a view of a fifth embodiment of the present invention.

Referring to FIG. 1, a view of a first embodiment of the stopper remover according to the present invention, the remover 10 comprises a sheet of mylar or the like which is symmetrical about longitudinal axis 16 and comprises an elongated handle member 12 of substantially greater length than width, and a flared portion 14 at the remote end thereof. In the embodiment of FIG. 1, the flared portion is roughly circular, its widest part being approximately twice the width of the narrower handle portion. The embodiment of FIG. 1 may have the following dimensions: length, 7 inches; narrowest width, 1.5 inches; and greatest width, 2.75 inches. These proportions are given by way of example and are not intended as limitations. The stopper remover is suitably constructed of a relatively thin material having high strength. In the preferred embodiment, the remover 10 is constructed of 5 mil mylar although other thicknesses may be employed and flexible materials other than mylar may also be used, for example, other plastics. Even cloth can be used although a stiff bottle-insertable material is preferred.

Figure 8:
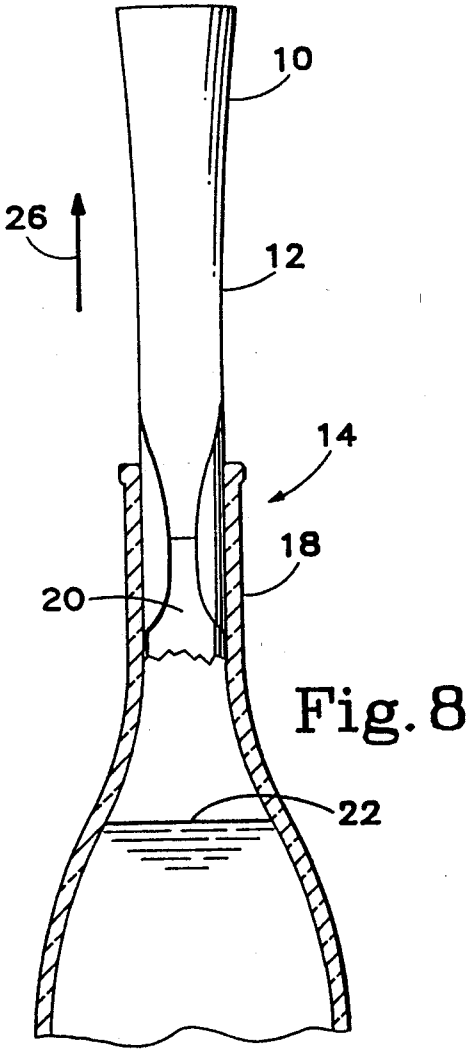
FIGS. 6–8 illustrate the use of the stopper remover in recovering a stopper from a bottle.
Figure 7:
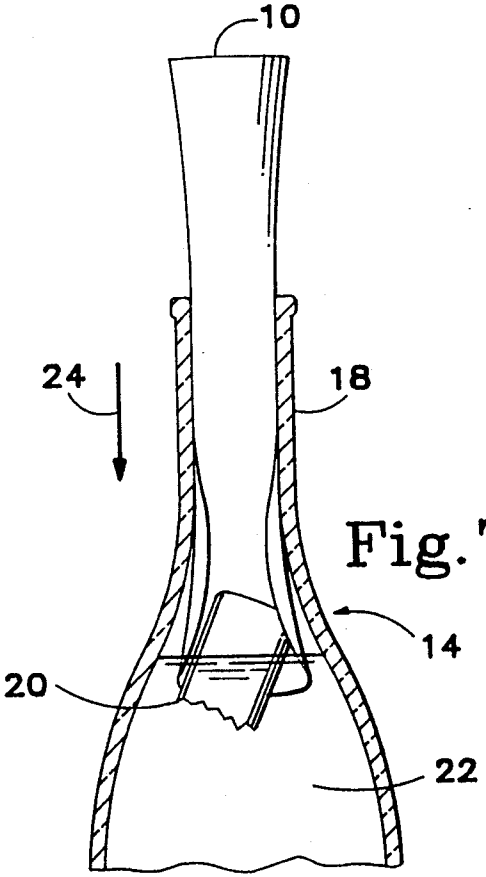
Figure 6:
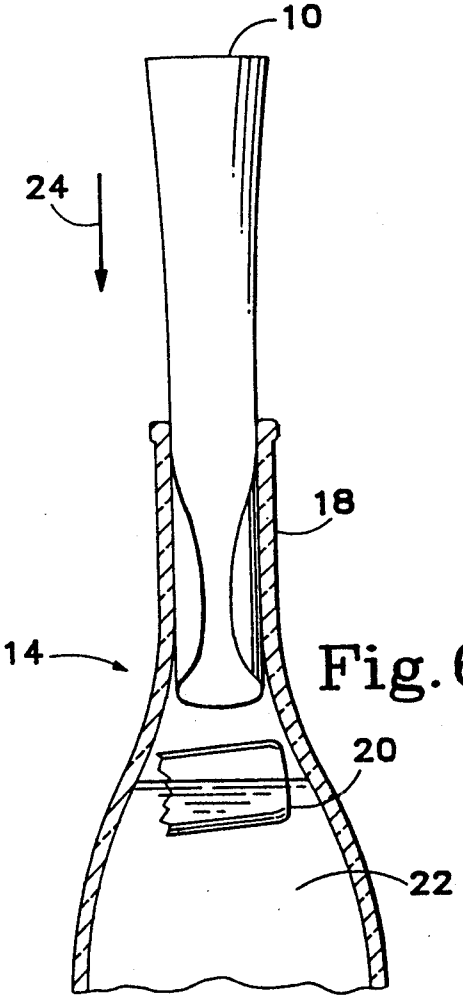

The steps of employing the invention to remove a stopper are better understood with reference to FIGS. 6–8 taken in conjunction with FIG. 1. FIG. 6 is a cross sectional view of a bottle 18, having a stopper portion 20 therewithin floating in liquid 22. The stopper portion in this illustration is broken, having been forced within the interior of the bottle during a previous attempt to remove the stopper. Stopper 20 is typically a cork. In use, the flared portion 14 of the remover is first curled somewhat around longitudinal axis 16 (FIG. 1) so that it may enter the bottle neck, and is forced into the neck of bottle 18 (FIG. 6). The remover is then lowered into the interior of the bottle in the direction of arrow 24.

Referring to FIG. 7, it may be observed that the remover is lowered far enough into the bottle (in the direction of arrow 24) so that the flared portion 14 is at or below the level at which the stopper is floating and so that it is in semi-surrounding relation to the stopper. The flared portion, having passed through the narrowest portion of the bottle neck, has begun to unfurl slightly, providing a scoop area suitable for capturing the floating stopper and moving it centrally. It can be advantageous to plunge the remover up and down, to properly position the stopper so as to be in a substantially vertical position relative to the bottle neck. However, this step is not generally necessary.

Referring now to FIG. 8, with the stopper positioned within the flared curled end of the remover, the extraction process begins. The operator of the remover tightly grasps the handle portion 12 and pulls the remover up and out of the bottle, along the direction of arrow 26. As the remover is so extracted, the stopper 20 is quickly captured and grasped within the flared portion 14. The flared portion constricts somewhat as it is pulled upwardly for engaging and pulling the stopper up out of the liquid into the neck of the bottle. The remover may then be pulled quickly out of the neck of the bottle, and the stopper 20 will accompany the remover up through the bottle neck. When the remover is pulled up and out rapidly, the stopper may actually fly upwardly with a resounding popping noise when it clears the bottle neck. The strong material of which the remover is constructed (suitably mylar) allows the narrow handle portion of the remover to be gripped and wrapped around a user's hand for extracting even stoppers as may become tightly engaged within the neck portion of the bottle. It is postulated that in addition to frictional engagement between the stopper and the flared portion of the remover, the surface tension of the liquid within the bottle assists in easily and automatically capturing the cork with the flared portion of the remover, and in keeping the cork within the remover.

FIGS. 2–5 illustrate alternative embodiments of the stopper remover according the present invention. FIG. 2 illustrates a remover 10 wherein the flared portion 14 is somewhat more elongated approximating the shape of a spoon rather than the circular shape of FIG. 1, while the embodiment of FIG. 3 employs a spade-shaped flared portion.

Referring to FIG. 4, a further embodiment of the invention employs a paddle-shaped linear flared portion, rather than the curved flares of the embodiments of FIGS. 1–3. The remover 10 of FIG. 4 includes handle member 12, extending to a point roughly two-thirds down the length of the remover where angularly flared portion 15 begins. In this illustrated embodiment, the angularly flared portion extends away from each edge of the handle portion at an angle of approximately 75 degrees. The embodiment of FIG. 4 includes a flat edge 17 at the bottom of the flared area.

FIG. 5 illustrates still another embodiment of the invention, wherein the flared portion 15 extends only part way to the lower end of the remover, and wherein a lower angularly flared edge 19 proceeds back toward the longitudinal centerline 16 of the remover to provide a pointed end for facilitating insertion of the flared portion into the bottle. Since the remover is symmetrical, the inwardly extending edge 19 meets at the centerline with a similar edge 19'. While preferred embodiments of the present invention are advantageously provided with a flared shape at the lower end thereof to enhance grasping of the stopper with the lower end and easy handling at the upper end, it is also possible to employ a stopper remover with a substantially straight side edge.

The remover of the present invention can also be advantageously provided with a looped portion at the non-flared end, to enable the remover to be hung over the neck of a bottle, ensuring that the remover is easily accessible when needed.

The present invention is further adapted to replace a corkscrew or other stopper removal device. The relatively thin and flexible nature of the invention makes it suitable to be easily carried, and it can be used as an emergency stopper remover. First a stopper is forced down into a bottle interior, and then the remover according to the present invention is employed to extract the stopper from the bottle.

While the illustrated use of the invention is for completely withdrawing stoppers from bottles, the remover is also advantageously employed to simply bring the stopper back into the neck of the bottle, enabling ultimate extraction of the stopper by some other means (e.g. with a corkscrew).

While several embodiments of the present invention have been shown and described, it will be apparent to those skilled in the art that many changes and modifications may be made without departing from the invention in its broader aspects. The appended claims are therefore intended to cover all such changes and modifications as fall within the true spirit and scope of the invention.

I claim:

1. A method for retrieving a stopper from a bottle comprising the steps of:

longitudinally curling at least one end of a relatively thin elongate member, wherein said elongate member is formed of a material other than cloth;

inserting the curled end of the member into the mouth of the bottle;

positioning the curled end to place the cork within the inserted curled portion; and extracting the elongate member from the bottle by pulling the elongate member outwardly from the bottle.

2. The method according to claim 1 wherein said elongate member is formed of mylar.

3. The method according to claim 1 wherein said elongate member comprises mylar having a thickness on the order of 5 mils.

4. The method according to claim 1 further comprising the step of pressing the stopper into the interior of the bottle before said step of inserting the curled member within the bottle.

5. The method according to claim 1 wherein said step of inserting the curled member into the mouth of the bottle further comprises inserting the curled member into the bottle a sufficient distance to enable the inserted end of the curled member to unfurl slightly to assist with grabbing the stopper.

6. The method according to claim 1 wherein the elongate member has a flared portion at the insertion end thereof.

7. The method according to claim 1 wherein said elongate member is formed of plastic.

8. The method according to claim 1 wherein said elongate member is formed of a substantially non-absorbent material.

9. A stopper extractor for removing a stopper which has fallen within a bottle, comprising:

an elongate member formed of flexible sheet material capable of being curled along the longitudinal axis thereof, yet adapted to return to its shape prior to curling when released;

said member having a flared portion at an end of said elongate member for insertion within the neck of a bottle.

10. A stopper extractor for removing a stopper which has fallen within a bottle, comprising:

an elongate member formed of mylar sheet material capable of being curled along the longitudinal axis thereof;

said member having a flared portion at an end of said elongate member for insertion within the neck of a bottle.

11. A stopper extractor for removing a stopper which has fallen within a bottle, comprising:

an elongate member formed of mylar sheet material capable of being curled along the longitudinal axis thereof and having a thickness on the order of 5 mils;

said member having a flared portion at an end of said elongate member for insertion within the neck of a bottle.

12. A stopper extractor according to claim 9 wherein said flared portion is circular.

13. A stopper extractor according to claim 9 wherein said flared portion has the shape of a spoon.

14. A stopper extractor according to claim 9 wherein said flared portion has the shape of a spade.

15. A stopper extractor according to claim 9 wherein said flared portion has the shape of a paddle.

16. A stopper extractor according to claim 9 wherein said flared portion is pointed.

17. A stopper extractor according to claim 9 wherein said elongate member is formed of plastic.

18. A stopper extractor according to claim 9 wherein said elongate member is formed of a substantially non-absorbent material.

* * * * *

UNITED STATES PATENT AND TRADEMARK OFFICE

CERTIFICATE OF CORRECTION

PATENT NO. : 5,253,553

DATED : October 19, 1993

INVENTOR(S) : Michael Mothershead

It is certified that error appears in the above-identified patent and that said Letters Patent is hereby corrected as shown below:

Column 4, line 17, "cork" should read --stopper--.

Signed and Sealed this

Twelfth Day of April, 1994

*Attest:*

*Attesting Officer*

BRUCE LEHMAN

*Commissioner of Patents and Trademarks*